US009175521B2

(12) United States Patent
Bellin

(10) Patent No.: US 9,175,521 B2
(45) Date of Patent: Nov. 3, 2015

(54) FUNCTIONALLY LEACHED PCD CUTTER AND METHOD FOR FABRICATING THE SAME

(75) Inventor: Federico Bellin, Pau (FR)

(73) Assignee: VAREL EUROPE S.A.S., Pau (FR)

( * ) Notice: Subject to any disclaimer, the term of this patent is extended or adjusted under 35 U.S.C. 154(b) by 369 days.

(21) Appl. No.: 12/862,401

(22) Filed: Aug. 24, 2010

(65) Prior Publication Data

US 2012/0048625 A1 Mar. 1, 2012

(51) Int. Cl.
*E21B 10/46* (2006.01)
*E21B 10/567* (2006.01)

(52) U.S. Cl.
CPC ..... *E21B 10/5676* (2013.01)

(58) Field of Classification Search
CPC .... E21B 10/5673; E21B 10/567; E21B 10/46
USPC ..... 76/108.2; 175/426, 430, 434
See application file for complete search history.

(56) References Cited

U.S. PATENT DOCUMENTS

| | | | | |
|---|---|---|---|---|
| 4,592,433 | A | 6/1986 | Dennis | |
| 4,784,023 | A | 11/1988 | Dennis | |
| 4,984,642 | A | 1/1991 | Renard et al. | |
| 5,120,327 | A | 6/1992 | Dennis | |
| 5,217,081 | A * | 6/1993 | Waldenstrom et al. | 175/420.2 |
| 6,187,068 | B1 * | 2/2001 | Frushour et al. | 51/295 |
| 6,258,139 | B1 | 7/2001 | Jensen | |
| 6,488,106 | B1 | 12/2002 | Dourfaye | |
| 6,527,069 | B1 | 3/2003 | Meiners et al. | |
| 7,316,279 | B2 | 1/2008 | Wiseman et al. | |
| 7,517,589 | B2 | 4/2009 | Eyre | |
| 7,712,553 | B2 | 5/2010 | Shamburger | |
| 7,762,359 | B1 * | 7/2010 | Miess | 175/432 |
| 2005/0247492 | A1 | 11/2005 | Shen et al. | |
| 2006/0032677 | A1 | 2/2006 | Azar et al. | |
| 2006/0102389 | A1 | 5/2006 | Wiseman et al. | |

(Continued)

FOREIGN PATENT DOCUMENTS

| | | |
|---|---|---|
| CN | 1615373 | 5/2005 |
| CN | 1714224 | 12/2005 |
| CN | 1968777 | 8/2011 |

OTHER PUBLICATIONS

Lee W. Young, International Search Report and Written Opinion—PCT/US2011/048599, Jan. 18, 2012, 8 pages, ISA/US Commissioner for Patents, Alexandria, Virginia.

(Continued)

*Primary Examiner* — Catherine Loikith
(74) *Attorney, Agent, or Firm* — King & Spalding LLP

(57) ABSTRACT

A cutting table includes a cutting surface, an opposing surface, a cutting table outer wall, and one or more slots. The cutting table outer wall extends from the circumference of the opposing surface to the circumference of the cutting surface. The slots extend from a portion of the cutting surface to a portion of the cutting table outer wall. The cutting table is leached to form a thermally stable cutting table. One or more slots are positioned in parallel with at least another slot in some embodiments. In some embodiments, the slots are positioned circumferentially around the cutting surface. In some embodiments, at least one slot is backfilled with a backfilling material to increase heat transfer or impact resistance. In some embodiments, the cutting table is coupled to a substrate to form a cutter. The slots are formed either after or during the formation of the cutting table.

43 Claims, 9 Drawing Sheets

(56) References Cited

U.S. PATENT DOCUMENTS

| | | | | |
|---|---|---|---|---|
| 2006/0278442 | A1 | 12/2006 | Kristensen | |
| 2007/0278017 | A1 * | 12/2007 | Shen et al. | 175/426 |
| 2009/0152016 | A1 | 6/2009 | Eyre et al. | |
| 2009/0313908 | A1 | 12/2009 | Zhang et al. | |
| 2011/0031036 | A1 | 2/2011 | Patel | |

OTHER PUBLICATIONS

Lee W. Young, International Search Report and Written Opinion—PCT/US2011/048604, Jan. 18, 2012, 8 pages, ISA/US Commissioner for Patents, Alexandria, Virginia.

* cited by examiner

FUNCTIONALLY LEACHED PCD CUTTER AND METHOD FOR FABRICATING THE SAME

RELATED APPLICATIONS

The present application is related to U.S. patent application Ser. No. 12/862,531 entitled "PCD Cutter With Fins" and filed on Aug. 24, 2010, which is hereby incorporated by reference.

TECHNICAL FIELD

The present invention relates generally to polycrystalline diamond compact ("PDC") cutters; and more particularly, to PDC cutters having improved thermal stability.

BACKGROUND

Polycrystalline diamond compacts ("PDC") have been used in industrial applications, including rock drilling applications and metal machining applications. Such compacts have demonstrated advantages over some other types of cutting elements, such as better wear resistance and impact resistance. The PDC can be formed by sintering individual diamond particles together under the high pressure and high temperature ("HPHT") conditions referred to as the "diamond stable region," which is typically above forty kilobars and between 1,200 degrees Celsius and 2,000 degrees Celsius, in the presence of a catalyst/solvent which promotes diamond-diamond bonding. Some examples of catalyst/solvents for sintered diamond compacts are cobalt, nickel, iron, and other Group VIII metals. PDCs usually have a diamond content greater than seventy percent by volume, with about eighty percent to about ninety-five percent being typical. An unbacked PDC can be mechanically bonded to a tool (not shown), according to one example. Alternatively, the PDC can be bonded to a substrate, thereby forming a PDC cutter, which is typically insertable within a downhole tool (not shown), such as a drill bit or a reamer.

FIG. 1 shows a side view of a PDC cutter 100 having a polycrystalline diamond ("PCD") cutting table 110, or compact, in accordance with the prior art. Although a PCD cutting table 110 is described in the exemplary embodiment, other types of cutting tables, including cubic boron nitride ("CBN") compacts, are used in alternative types of cutters. Referring to FIG. 1, the PDC cutter 100 typically includes the PCD cutting table 110 and a substrate 150 that is coupled to the PCD cutting table 110. The PCD cutting table 110 is about one hundred thousandths of an inch (2.5 millimeters) thick; however, the thickness can vary depending upon the application.

The substrate 150 includes a top surface 152, a bottom surface 154, and a substrate outer wall 156 that extends from the circumference of the top surface 152 to the circumference of the bottom surface 154. The PCD cutting table 110 includes a cutting surface 112, an opposing surface 114, and a PCD cutting table outer wall 116 that extends from the circumference of the cutting surface 112 to the circumference of the opposing surface 114. According to some exemplary embodiments, a bevel (not shown) is formed around at least the circumference of the PCD cutting table 110. The opposing surface 114 of the PCD cutting table 110 is coupled to the top surface 152 of the substrate 150. Typically, the PCD cutting table 110 is coupled to the substrate 150 using a HPHT press. However, other methods known to people having ordinary skill in the art can be used to couple the PCD cutting table 110 to the substrate 150. In one embodiment, upon coupling the PCD cutting table 110 to the substrate 150, the cutting surface 112 of the PCD cutting table 110 is substantially parallel to the bottom surface 154 of the substrate 150. Additionally, the PDC cutter 100 has been illustrated as having a right circular cylindrical shape; however, the PDC cutter 100 is shaped into other geometric or non-geometric shapes in other embodiments. In certain embodiments, the opposing surface 114 and the top surface 152 are substantially planar; however, the opposing surface 114 and the top surface 152 can be non-planar in other embodiments.

According to one example, the PDC cutter 100 is formed by independently forming the PCD cutting table 110 and the substrate 150, and thereafter bonding the PCD cutting table 110 to the substrate 150. Alternatively, the substrate 150 is initially formed and the PCD cutting table 110 is then formed on the top surface 152 of the substrate 150 by placing polycrystalline diamond powder onto the top surface 152 and subjecting the polycrystalline diamond powder and the substrate 150 to a high temperature and high pressure process. Although two methods of forming the PDC cutter 100 have been briefly mentioned, other methods known to people having ordinary skill in the art can be used.

According to one example, the PCD cutting table 110 is bonded to the substrate 150, formed from a material such as cemented tungsten carbide, by subjecting a layer of diamond powder and a mixture of tungsten carbide and cobalt powders to HPHT conditions. The cobalt diffuses into the diamond powder during processing and therefore acts as both a catalyst/solvent for the sintering of the diamond powder to form diamond-diamond bonds and as a binder for the tungsten carbide. Voids are formed between the carbon-carbon bonds of the diamond. Strong bonds are formed between the PCD cutting table 110 and the cemented tungsten carbide substrate 150. The diffusion of cobalt into the diamond powder results in cobalt being deposited within the voids formed within the PCD cutting table 110. Although some materials, such as tungsten carbide and cobalt, have been provided as examples, other materials known to people having ordinary skill in the art can be used to form the substrate 150, the PCD cutting table 110, and form bonds between the substrate 150 and the PCD cutting table 110.

Since the cobalt, or catalyst material, is deposited within the voids formed within the PCD cutting table 110 and cobalt has a much higher thermal expansion rate than diamond, the PCD cutting table 110 becomes thermally degraded at temperatures above about 750 degrees Celsius and its cutting efficiency deteriorates significantly. Hence, typical leaching processes, which are known to people having ordinary skill in the art, have been used to react the deposited catalyst material, thereby removing the catalyst material from the voids.

All typical leaching processes involve the presence of an acid solution (not shown) which reacts with the catalyst material that is deposited within the voids of the PCD cutting table 110. According to one example of a typical leaching process, the PDC cutter is placed within an acid solution (not shown) such that at least a portion of the PCD cutting table 110 is submerged within the acid solution. The acid solution reacts with the catalyst material along the outer surfaces of the PCD cutting table 110. The acid solution slowly moves inwardly within the interior of the PCD cutting table 110 and continues to react with the catalyst material. However, as the acid solution moves further inwards, the reaction byproducts become increasingly more difficult to remove; and hence, the rate of leaching slows down considerably. For this reason, a tradeoff occurs between leaching process duration, wherein costs increase as the leaching duration increases, and catalyst removal depth.

FIG. 2 shows a perspective view of a thermally stable shell 200 of the PCD table 110 of FIG. 1 in accordance with the prior art. The thermally stable shell 200 is the portion of the PCD cutting table 110 (FIG. 1) that has been leached. The thermally stable shell 200 is formed along the outer surfaces of the PCD cutting table 110 (FIG. 1) using typical leaching processes and extends a catalyst removal depth 210 from the outer surfaces. Thus, the thermally stable shell 200 includes the cutting surface 112 and the PCD cutting table outer wall 116 of the PCD cutting table 110 (FIG. 1) and extends inwardly for about the catalyst removal depth 210. The thermally stable shell 200 is substantially cup-shaped and forms a cavity 215 therein. The cavity 215 is occupied by a catalyst rich PCD cutting table 310 (FIG. 3A). Thus, the PCD cutting table 110 (FIG. 1) includes the thermally stable shell 200 and the catalyst rich PCD cutting table 310 (FIG. 3A). The typical leaching processes involve the removal of catalyst material from a portion of the PCD cutting table 110 (FIG. 1), thereby forming the thermally stable shell 200. Usually, the catalyst removal depth 210 is uniform which is dictated by the leaching process governing parameters; however, the catalyst removal depth 210 can be non-uniform in certain examples. The catalyst removal depth 210 typically ranges from about two thousandths of an inch (0.05 millimeters) to about eight thousandths of an inch (0.2 millimeters), but can be greater in certain embodiments. The thermally stable shell 200 is substantially free of catalyst material and therefore provides a much greater thermal stability allowing the PDC cutter 100 (FIG. 1) to withstand the high flash tip temperatures generated by the interaction between rock and PDC cutter 100 (FIG. 1). The lack of catalyst material within the thermally stable shell 200 avoids the damage caused at a microscopic scale by the differential in the thermal expansion between the diamond network and the catalyst material and delays the onset of the diamond graphitization process.

FIG. 3A shows a perspective view of the PCD cutting table 110 developing a wear flat 300 in accordance with the prior art. The PCD cutting table 110 includes the thermally stable shell 200 surrounding portions of the catalyst rich PCD cutting table 310. As a portion of the thermally stable shell 200 is worn out by the interaction between the PCD cutting table 110 and the rock formation, the wear flat 300 is formed, thereby exposing a portion of the catalyst rich PCD cutting table 310. Hence, the wear flat 300 produces an interface 305 between the thermally stable shell 200 and the portion of the catalyst rich PCD cutting table 310. The portion of the catalyst rich PCD cutting table 310 also begins interacting with the rock formation along with the interaction between the thermally stable shell 200 and the rock formation, thereby speeding up the thermo-mechanical wear process of the PCD cutting table 110. This leads to a dramatic loss of cutting efficiency and greatly reduces the remaining life of the PDC cutter 100 (FIG. 100). As the thermally stable shell 200 is worn out and the portion of the catalyst rich PCD cutting table 310 becomes exposed, a second failure mechanism also occurs. The second failure mechanism involves having a portion of the thermally stable shell 200 and the portion of the catalyst rich PCD cutting table 310 both interacting with the rock formation. During the drilling application, cracks are forming at the interface 305 and the contact point of the interface 305 with the rock formation. Eventually, chips are created within the PCD cutting table 110, thereby accelerating PDC cutter 100 (FIG. 1) degradation.

FIG. 3B shows a perspective view of the PCD cutting table 110 developing a larger wear flat 350 in accordance with the prior art. As the drilling application continues and more rock is removed by the shearing action of the PCD cutting table 110, the size of the wear flat 350 increases, thereby exposing a larger portion of the catalyst rich PCD cutting table 310. As the wear progresses, the rate of damage accelerates caused by the thermal effect because there is a larger portion of the catalyst rich PCD cutting table 310 interacting with the rock formation and less thermally stable shell 200 interacting with the rock formation. The cobalt within the larger portion of the catalyst rich PCD cutting table 310 thermally expands at a different rate than the expansion of the diamonds, thereby increasing the rate of damage.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
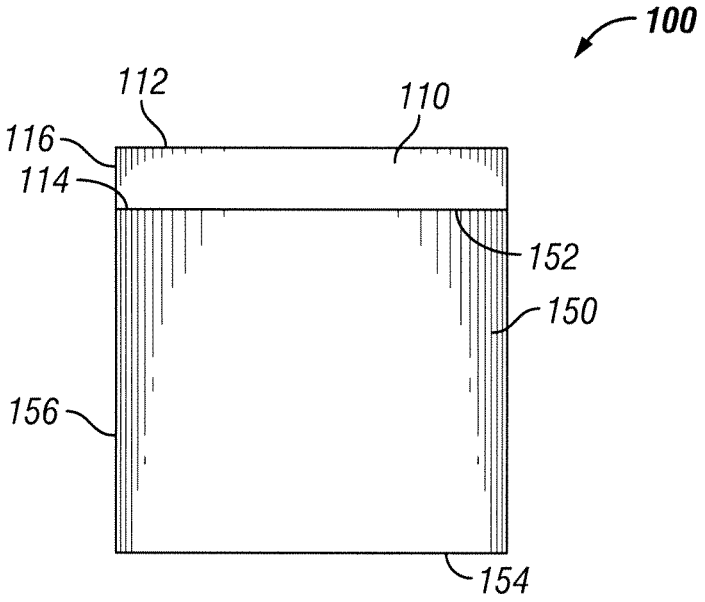
FIG. 1 (Prior Art)
FIG. 1 shows a side view of a PDC cutter having a PCD cutting table in accordance with the prior art.
Figure 2:
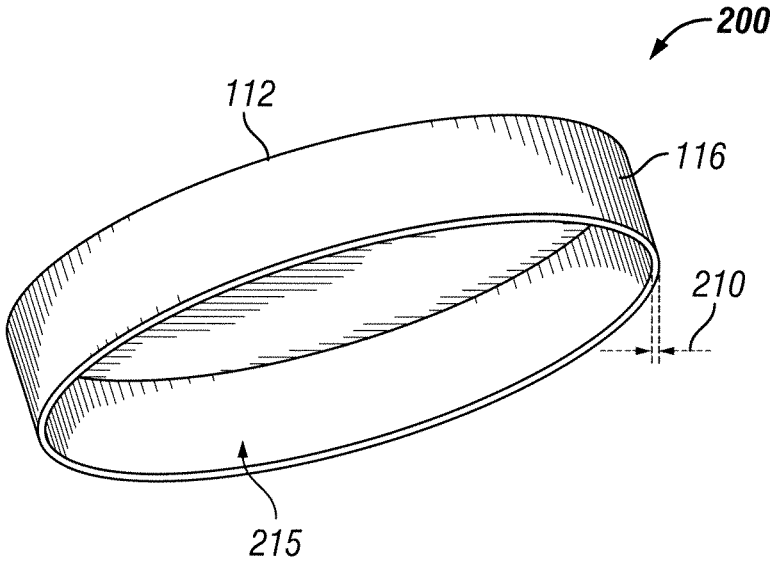
FIG. 2 (Prior Art)
FIG. 2 shows a perspective view of a thermally stable shell of the PCD cutting table of FIG. 1 in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to polycrystalline diamond compact ("PDC") cutters; and more particularly, to PDC cutters having improved thermal stability. Although the description of exemplary embodiments is provided below in conjunction with a PDC cutter, alternate embodiments of the invention may be applicable to other types of cutters or compacts including, but not limited to, polycrystalline boron nitride ("PCBN") cutters or PCBN compacts. The invention is better understood by reading the following description of non-limiting, exemplary embodiments with reference to the attached drawings, wherein like parts of each of the figures are identified by like reference characters, and which are briefly described as follows.

Figure 4:
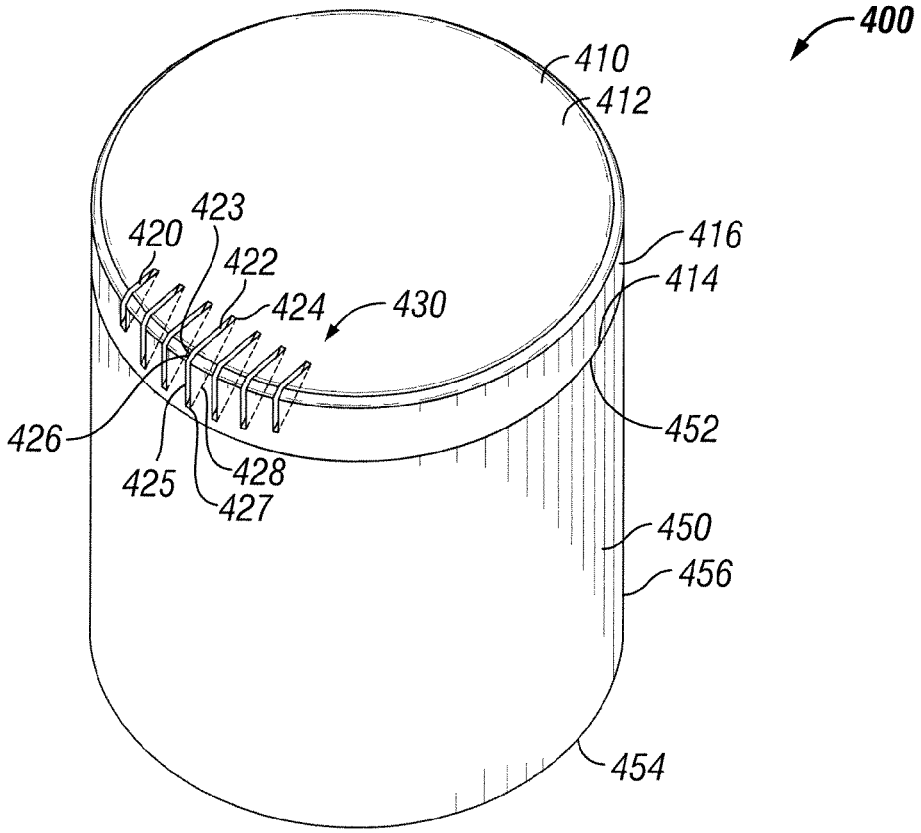
FIG. 4 shows a perspective view of a PDC cutter having a PCD cutting table in accordance with an exemplary embodiment of the present invention.

FIG. 4 shows a perspective view of a PDC cutter 400 having a PCD cutting table 410 in accordance with an exemplary embodiment of the present invention. Although a PCD cutting table 410 is described in the exemplary embodiment, other types of cutting tables, including cubic boron nitride ("CBN") compacts, are used in alternative types of cutters. Referring to FIG. 4, the PDC cutter 400 includes the PCD cutting table 410 and a substrate 450 that is coupled to the PCD cutting table 410. The PCD cutting table 410 is similar to the PDC cutting table 110 (FIG. 1), and the substrate 450 is similar to the substrate 150 (FIG. 1). However, the PCD cutting table 410 is more thermally stable and has a longer life than the PCD cutting table 110 (FIG. 1), which is described in further detail below. For the same optimal leaching duration, PCD cutting table 410 has more catalyst material removed than PCD cutting table 110 (FIG. 1). The PCD cutting table 410 is about one hundred thousandths of an inch (2.5 millimeters) thick; however, the thickness can vary greater or less depending upon the application and/or manufacturing preferences, which can be based upon costs.

The substrate 450 includes a top surface 452, a bottom surface 454, and a substrate outer wall 456 that extends from the circumference of the top surface 452 to the circumference of the bottom surface 454. The substrate 450 is formed into a right circular cylindrical shape according to one exemplary embodiment, but can be formed into other geometric or non-geometric shapes depending upon the application for the PDC cutter 400. According to one exemplary embodiment, the substrate 450 is formed using tungsten carbide powder and cobalt subjected to high pressures and high temperatures; however, other suitable materials known to people having ordinary skill in the art can be used without departing from the scope and spirit of the exemplary embodiment.

The PCD cutting table 410 includes a cutting surface 412, an opposing surface 414, a PCD cutting table outer wall 416 that extends from the circumference of the cutting surface 412 to the circumference of the opposing surface 414, and one or more slots 420 extending from a portion of the cutting surface 412 to a portion of the PCD cutting table outer wall 416. According to some exemplary embodiments, a bevel (not shown) is formed around at least the circumference of the PCD cutting table 410. According to one exemplary embodiment, the PCD cutting table 410 is formed using diamond powder and catalyst material, such as cobalt, subjected to high pressures and high temperatures; however, other suitable materials known to people having ordinary skill in the art can be used without departing from the scope and spirit of the exemplary embodiment. The slots 420 are formed into the PDC cutting table 410 either after the PCD cutting table 410 is formed or during the sintering process that forms the PCD cutting table 410, which are both described in further detail below.

The PCD cutting table 410 is bonded to the substrate 450 according to methods known to people having ordinary skill in the art. In one example, the PDC cutter 400 is formed by independently forming the PCD cutting table 410 and the substrate 450, and thereafter bonding the PCD cutting table 410 to the substrate 450. In another example, the substrate 450 is initially formed and the PCD cutting table 410 is then formed on the top surface 452 of the substrate 450 by placing polycrystalline diamond powder onto the top surface 454 and subjecting the polycrystalline diamond powder and the substrate to a high temperature and high pressure process.

In one exemplary embodiment, upon coupling the PCD cutting table 410 to the substrate 450, the cutting surface 412 of the PCD cutting table 410 is substantially parallel to the bottom surface 454 of the substrate 450. Additionally, the PDC cutter 400 has been illustrated as having a right circular cylindrical shape; however, the PDC cutter 400 is shaped into other geometric or non-geometric shapes in other exemplary embodiments. In certain exemplary embodiments, the opposing surface 414 and the top surface 452 are substantially planar; however, the opposing surface 414 and the top surface 452 can be non-planar in other exemplary embodiments.

According to one example, the PCD cutting table 410 is bonded to the substrate 450, such as cemented tungsten carbide, by subjecting a layer of diamond powder with or without cobalt powders to HPHT conditions. The cobalt diffuses into the diamond powder during processing and therefore acts as both a catalyst/solvent for the sintering of the diamond powder to form diamond-diamond bonds and as a binder for the tungsten carbide. Strong bonds are formed between the PCD cutting table 410 and the cemented tungsten carbide substrate 450. The diffusion of cobalt into the diamond powder results in cobalt being deposited within the voids formed within the PCD cutting table 410. Although some materials, such as tungsten carbide and cobalt, have been provided as examples, other materials known to people having ordinary skill in the art can be used to form the substrate 450, the PCD cutting table 410, and form bonds between the substrate 450 and the PCD cutting table 410.

Since the cobalt, or catalyst material, is deposited within the voids formed within the PCD cutting table 410 and cobalt has a much higher thermal expansion rate than the diamond within the PCD cutting table 410, the PCD cutting table 410 is subjected to a leaching process to improve its thermal stability. As previously mentioned, the leaching process removes catalyst material from the voids formed between the carbon bonds. Due to the tradeoff between leaching process duration and leaching depth, the leaching depth is about 0.2 millimeters; however, the leaching depth can be varied depending upon the application and cost constraints. The leaching depth is increased by subjecting the PCD cutting table 410 to a longer duration of the leaching process.

Each slot 420 is substantially triangularly shaped and includes a slot latitudinal edge 422, a slot longitudinal edge 425, and a first slot angular edge 428. The slot latitudinal edge 422 is formed along a portion of the cutting surface 412. The slot longitudinal edge 425 is formed along a portion of the PCD cutting table outer wall 416. The first slot angular edge 428 extends from a portion of the slot latitudinal edge 422 to a portion of the slot longitudinal edge 425. The portion of the PCD cutting table 410 that is bounded by the slot latitudinal edge 422, the slot longitudinal edge 425, and the first slot angular edge 428 is removed, thereby forming the slot 420. Although some exemplary embodiments include triangularly shaped slots 420, other exemplary embodiments have slots that are shaped in other geometric, such as square, rectangular, or tubular, or non-geometric shapes without departing from the scope and spirit of the exemplary embodiment. The slots 420 are formed substantially near the outer perimeter of the PCD cutting table 410 since that is the area performing most of the cutting. The slots 420 formed within the PCD cutting table 410 provide greater accessible surface area of the PCD cutting table 410 for the leaching process. Hence, a greater volume of the PCD cutting table 410 is subjected to the treatment of the leaching process; thereby forming an improved PCD cutting table 410 that is more thermally stable than the PCD cutting table 110 (FIG. 1) in the area performing most of the cutting.

The slot latitudinal edge 422 includes a slot latitudinal adjacent end 423 and a slot latitudinal distal end 424 and extends from the slot latitudinal adjacent end 423 to the slot latitudinal distal end 424 substantially linearly. However, in other exemplary embodiments, the slot latitudinal edge 422 is substantially circular and includes the slot latitudinal adjacent end 423 and the slot latitudinal distal end 424 along opposing ends of the circumference of the slot latitudinal edge 422. The slot latitudinal adjacent end 423 is substantially positioned at a point along the circumference of the cutting surface 412. However, according to other exemplary embodiments, the slot latitudinal adjacent end 423 is positioned at a point within the circumference of the cutting surface 412. The slot latitudinal distal end 424 is positioned at a point within the circumference of the cutting surface 412 and closer towards the center of the cutting surface 412 than the positioning of the slot latitudinal adjacent end 423.

The slot longitudinal edge 425 includes a slot longitudinal adjacent end 426 and a slot longitudinal distal end 427 and extends from the slot longitudinal adjacent end 426 to the slot longitudinal distal end 427 substantially linearly. However, in other exemplary embodiments, the slot longitudinal edge 425 is substantially circular and includes the slot longitudinal adjacent end 426 and the slot longitudinal distal end 427 along opposing ends of the circumference of the slot longitudinal edge 425. The slot longitudinal adjacent end 426 is positioned at a point along the PCD cutting table outer wall 416 where the PCD cutting table outer wall 416 meets with the circumference of the cutting surface 412. Thus, the positioning of the slot latitudinal adjacent end 423 and the slot longitudinal adjacent end 426 is the same. However, according to other exemplary embodiments, the slot longitudinal adjacent end 426 is positioned along the PCD cutting table outer wall 416 at a point below where the PCD cutting table outer wall 416 meets with the circumference of the cutting surface 412. According to these exemplary embodiments, the positioning of the slot latitudinal adjacent end 423 and the slot longitudinal adjacent end 426 are different. The slot longitudinal distal end 427 is positioned along the PCD cutting table outer wall 416 at a point below the slot longitudinal adjacent end 426, which is further away from where the PCD cutting table outer wall 416 meets with the circumference of the cutting surface 412 when compared to the positioning of the slot longitudinal adjacent end 426. The slot longitudinal distal end 427 is vertically aligned with the slot longitudinal adjacent end 426. In other exemplary embodiments, however, the slot longitudinal distal end 427 is not vertically aligned with the slot longitudinal adjacent end 426. For example, the slot longitudinal distal end 427 is horizontally aligned with the slot longitudinal adjacent end 426 in certain exemplary embodiments. In another example, the slot longitudinal distal end 427 is not vertically nor horizontally aligned with the slot longitudinal adjacent end 426 in other exemplary embodiments.

The first slot angular edge 428 extends from the slot latitudinal distal end 424 to the slot longitudinal distal end 427. The first slot angular edge 428 forms an angle ranging from about five degrees to about eighty-five degrees to the cutting surface 412, which is dependent upon the thickness of the PCD cutting table 410. According to some exemplary embodiments, the first slot angular edge 428 forms an angle with respect to the cutting surface 412 that is about equal to the backrake angle of the cutter 400 when positioned in a downhole tool (not shown). In certain exemplary embodiments, where the positioning of the slot latitudinal adjacent end 423 and the slot longitudinal adjacent end 426 are different, a second slot angular edge (not shown) is formed extending from the slot latitudinal adjacent end 423 to the slot longitudinal adjacent end 426. According to these alternative exemplary embodiments, the portion of the PCD cutting table 410 that is bounded by the slot latitudinal edge 422, the slot longitudinal edge 425, the first slot angular edge 428, and the second slot angular edge is removed, thereby forming the slot.

There are seven slots 420 formed in a group 430 on the PCD cutting table 410 according to the illustrated exemplary embodiment. The slots 420 are parallel to one another and are formed substantially adjacent to one another. The slots 420 are formed having a depth that varies from 0.1 millimeters to about several millimeters depending upon the thickness of the PCD cutting table 410. Additionally, the slots 420 are formed where the slot longitudinal edge 425 are at substantially right angles to the cutting surface 412. Further, each of slots 420 are spaced apart equidistantly from one another.

Although seven slots 420 are illustrated in one exemplary embodiment, the number of slots 420 is greater or fewer according to other exemplary embodiments. The number of slots 420 can vary from one to about fifty or even more depending upon the size of the cutter 400 and/or the thickness of the slots 420. In some exemplary embodiments, each of the slots 420 are the same; however, in alternative exemplary embodiments, one or more of the slots 420 are different. For example, at least one slot 420 includes a first slot angular edge 428 that forms an angle with the cutting surface 412 that is different than the angle formed between the first slot angular edge and the cutting surface of another slot. In another example, the length of at least one of the slot latitudinal edge 422 and the slot longitudinal edge 425 of one slot 420 is different than at least one corresponding dimension of another slot. The differences in the slots' dimensions, shape, and/or orientation is allowed in certain exemplary embodiments to optimize the volume of the PDC cutting table 410 that is subjected to the leaching process.

Additionally, although the slots 420 are formed parallel to one another according to the illustrated exemplary embodiment, the slots 420 are formed in a circumferential array, or radially, around the outer perimeter of the PCD cutting table 410 in other exemplary embodiments. According to some exemplary embodiments, the circumferential array of slots 420 is formed around a portion of the perimeter of the PCD cutting table 410. According to other exemplary embodiments, the circumferential array of slots 420 is formed around the entire perimeter of the PCD cutting table 410. The minimum spacing between the slots 420 is about thirty-three thousandths of an inch according to some exemplary embodiments; however, other exemplary embodiments have a minimum spacing between adjacent slots 420 being less than thirty-three thousandths of an inch. Although the illustrated embodiment depicts the slot longitudinal edge 425 being formed at right angles to the cutting surface 412, the slot longitudinal edge 425 can be formed at angles ranging from five degrees to about 175 degrees to the cutting surface 412. Further, although the slots 420 are formed equidistantly from one another, the spacing between adjacent slots can be varied in certain exemplary embodiments.

In some exemplary embodiments, one or more groups 430 of slots 420 are formed around the PCD cutting table 410 so that the cutter 400 can be removed, rotated, and reinserted into the downhole tool, or other tool, for reuse, thereby providing a new, or fresh, edge of the PDC cutting table 410 for cutting. For example, once a first group 430 of slots 420 are worn away by cutting a rock formation, the cutter 400 can be rotated to expose an unworn group (not shown) of slots 420 for further cutting of the rock formation. The groups 430 are separated by about forty-five to about 180 degrees apart depending upon the exemplary embodiment.

According to some exemplary embodiments, the slots 420 are formed after the PCD cutting table 410 is formed. In one example, the slots 420 are formed mechanically using a grinding wheel and/or a saw blade. In another example, the slots 420 are formed using an electric discharge machine, such as a wire electrical discharge machining ("wire EDM"). In yet another example, the slots 420 are formed using laser cutting machines. Although a few examples have been provided for forming the slots 420, other methods known to people having ordinary skill in the art having the benefit of the present disclosure can be used without departing from the scope and spirit of the exemplary embodiment. In some alternative exemplary embodiments, the slots 420 are formed during the high pressure high temperature sintering process of the PCD cutting table 410, which is described in further detail below.

Figure 5:
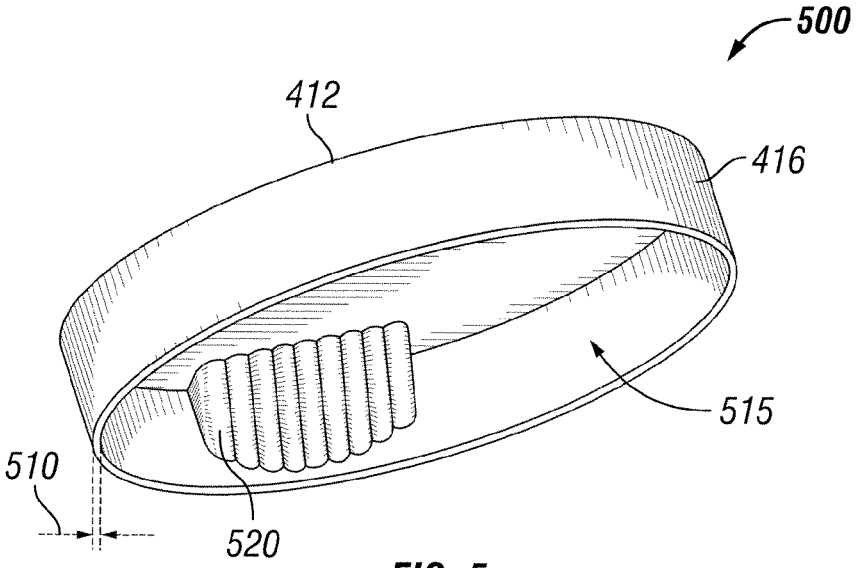
FIG. 5 shows a perspective view of a thermally stable shell of the PCD cutting table of FIG. 4 in accordance with an exemplary embodiment of the present invention.

FIG. 5 shows a perspective view of a thermally stable shell 500 of the PCD cutting table 410 of FIG. 4 in accordance with an exemplary embodiment of the present invention. The thermally stable shell 500 is the portion of the PCD cutting table 410 (FIG. 4) that has been leached, or has had the catalyst material removed. The thermally stable shell 500 is formed along the outer surfaces of the PCD cutting table 410 (FIG. 4) using leaching processes known to people having ordinary skill in the art. The thermally stable shell 500 extends a catalyst removal depth 510 into the interior portions of the PCD cutting table 410 from the outer surfaces, which includes the cutting surface 412, the PCD cutting table outer wall 416, and the slots 410 (FIG. 4). Hence, the thermally stable shell 500 includes the cutting surface 412, the PCD cutting table outer wall 416 of the PCD cutting table 410 (FIG. 4), and the slots 420 (FIG. 410) and extends inwardly into the PCD cutting table 410 (FIG. 4) for about the catalyst removal depth 510 from each of the cutting surface 412, the PCD cutting table outer wall 416 of the PCD cutting table 410 (FIG. 4), and the slots 420 (FIG. 4). The thermally stable shell 500 is substantially cup-shaped and forms a cavity 515 therein. Within the interior portion of the substantially cup-shaped thermally stable shell 500, one or more ribs 520 are formed therein. These ribs 520 form a portion of the thermally stable shell 500 and are formed due to the inwardly moving leaching process occurring around the slots 420 (FIG. 4). According to some exemplary embodiments, at least one rib 520 is in contact with at least one adjacent rib 520. The cavity 515 is occupied by a catalyst rich PCD cutting table 610 (FIG. 6B). Thus, the PCD cutting table 410 (FIG. 4) includes the thermally stable shell 500 and the catalyst rich PCD cutting table 610 (FIG. 6B).

The leaching process involves the removal of catalyst material from a portion of the PCD cutting table 410 (FIG. 4), thereby forming the thermally stable shell 500. Usually, the catalyst removal depth 510 is uniform which is dictated by the leaching process governing parameters; however, the catalyst removal depth 510 can be non-uniform in certain examples. The catalyst removal depth 510 typically ranges from about two thousandths of an inch (0.05 millimeters) to about eight thousandths of an inch (0.2 millimeters), but can be greater in certain embodiments. The thermally stable shell 500 is substantially free of catalyst material and therefore provides a much greater thermal stability allowing the PDC cutter 400 (FIG. 4) to withstand the high flash tip temperatures generated by the interaction between rock and PDC cutter 400 (FIG. 4). The lack of catalyst material within the thermally stable shell 500 avoids the damage caused at a microscopic scale by the differential in the thermal expansion between the diamond network and the catalyst material and delays the onset of the diamond graphitization process.

Figure 3A:
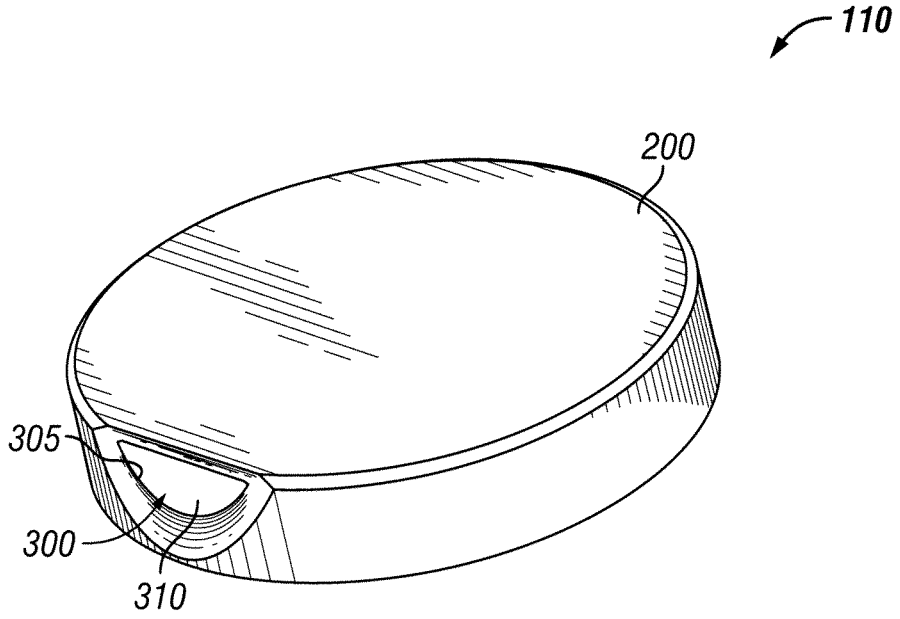
FIG. 3A (Prior Art)
FIG. 3A shows a perspective view of the PCD cutting table developing a wear flat in accordance with the prior art.
Figure 6A:
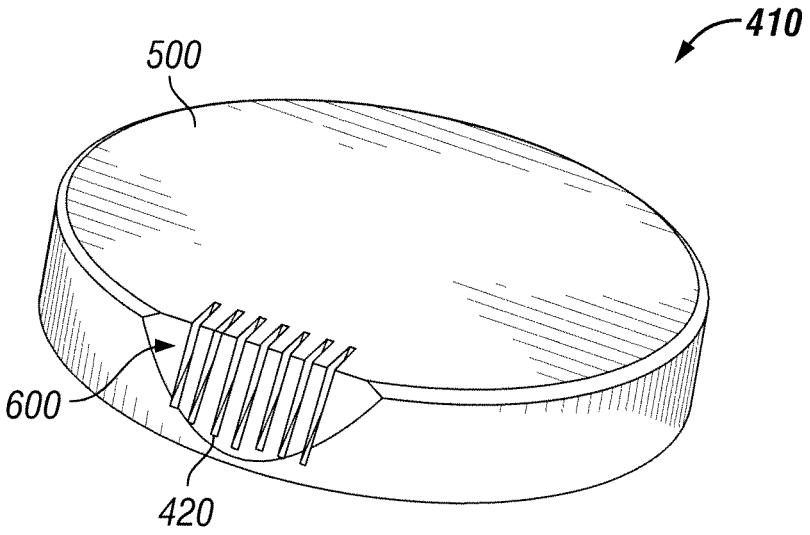
FIG. 6A shows a perspective view of the PCD cutting table developing a wear flat in accordance with an exemplary embodiment of the present invention.
Figure 6B:
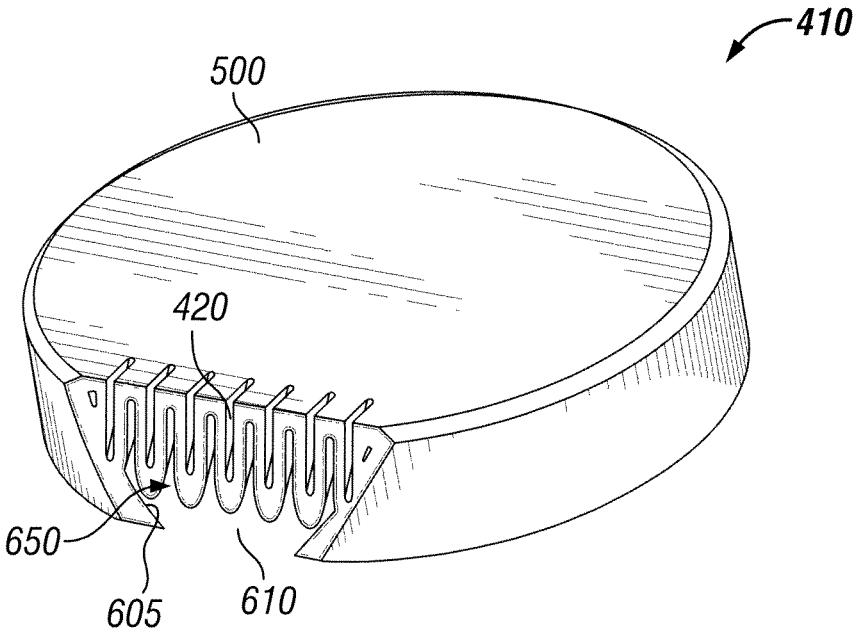
FIG. 6B shows a perspective view of the PCD cutting table developing a larger wear flat in accordance with an exemplary embodiment of the present invention.

FIG. 6A shows a perspective view of the PCD cutting table 410 developing a wear flat 600 in accordance with an exemplary embodiment of the present invention. The PCD cutting table 410 includes the thermally stable shell 500 surrounding portions of the catalyst rich PCD cutting table 610 (FIG. 6B). FIG. 6A depicts a wear flat 600 that is the same size as the wear flat 300 (FIG. 3A). As a portion of the thermally stable shell 500 is worn out by the interaction between the PCD cutting table 410 and the rock formation, the wear flat 600 is formed. Wear flat 600 does not yet expose portions of the catalyst rich PCD cutting table 610 (FIG. 6B) as does wear flat 300 (FIG. 3A). Portions of the PCD cutting table 410 located between the slots 420 are part of the thermally stable shell 500 and not part of the catalyst rich PCD cutting table 610 (FIG. 6B). Hence, the wear flat 600 provides exposure of only the thermally stable shell 500. There is no interface 605 (FIG. 6B) that is formed and exposed between the thermally stable shell 500 and the catalyst rich PCD cutting table 610 (FIG. 6B); thereby, reducing the possibility of crack formation in the PCD cutting table 410. PCD cutting table 410, therefore, has an increased life compared to PCD cutting table 110 (FIG. 1) because increased degradation occurring due to exposure of the catalyst rich PCD cutting table 610 (FIG. 6B) is not occurring. This benefit is realized by performing the leaching process on the PCD cutting table 410, which includes slots 420.

Figure 3B:
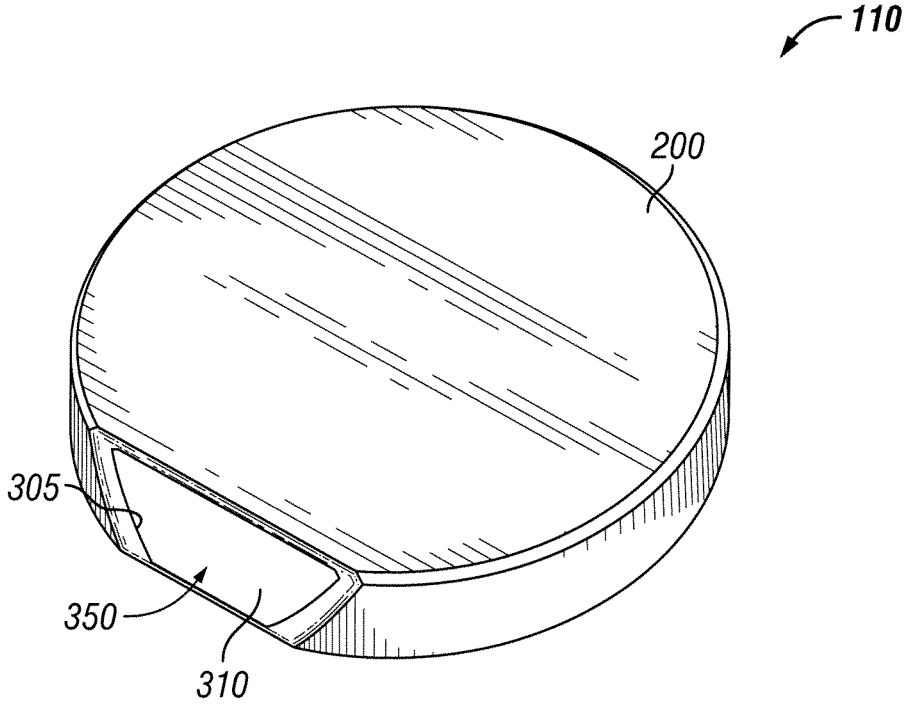
FIG. 3B (Prior Art)
FIG. 3B shows a perspective view of the PCD cutting table developing a larger wear flat in accordance with the prior art.

FIG. 6B shows a perspective view of the PCD cutting table 410 developing a larger wear flat 650 in accordance with an exemplary embodiment of the present invention. As the drilling application continues and more rock is removed by the shearing action of the PCD cutting table 410 on the rock formation, the size of the wear flat 650 increases; thereby, eventually exposing a portion of the catalyst rich PCD cutting table 610. The size of the wear flat 650 is the same as the size of wear flat 350 (FIG. 3B). Once PCD cutting table 410 has a wear flat 650, there is still substantially more thermally stable shell 500 being exposed for cutting than catalyst rich PCD cutting table 610. The wear flat 650 produces an interface 605 between the thermally stable shell 500 and a portion of the catalyst rich PCD cutting table 610. The portion of the catalyst rich PCD cutting table 610 also begins interacting with the rock formation along with the interaction between the thermally stable shell 500 and the rock formation; thereby, increasing the thermo-mechanical wear process of the PCD cutting table 410. As the thermally stable shell 500 is worn out and the portion of the catalyst rich PCD cutting table 610 becomes exposed, a second failure mechanism also occurs. The second failure mechanism involves having a portion of the thermally stable shell 500 and the portion of the catalyst rich PCD cutting table 610 both interacting with the rock formation, which thereby forms cracks at the interface 605 and the contact point of the interface 605 with the rock formation. When comparing wear flat 650 of PDC cutting table 410 and wear flat 350 (FIG. 3B) of PDC cutting table 110 (FIG. 3B), PDC cutting table 410 has significantly more thermally stable shell 500 being exposed and less catalyst rich PCD cutting table 610 being exposed for cutting. Further, interface 605 has a substantially less surface area than interface 305 (FIG. 3B). Thus, for the reasons mentioned above, PDC cutting table 410 performs better, has reduced degradation, and has a longer life than PDC cutting table 110 (FIG. 3B). Again, this benefit is realized by performing the leaching process on the PCD cutting table 410, which includes slots 420.

Figure 7:
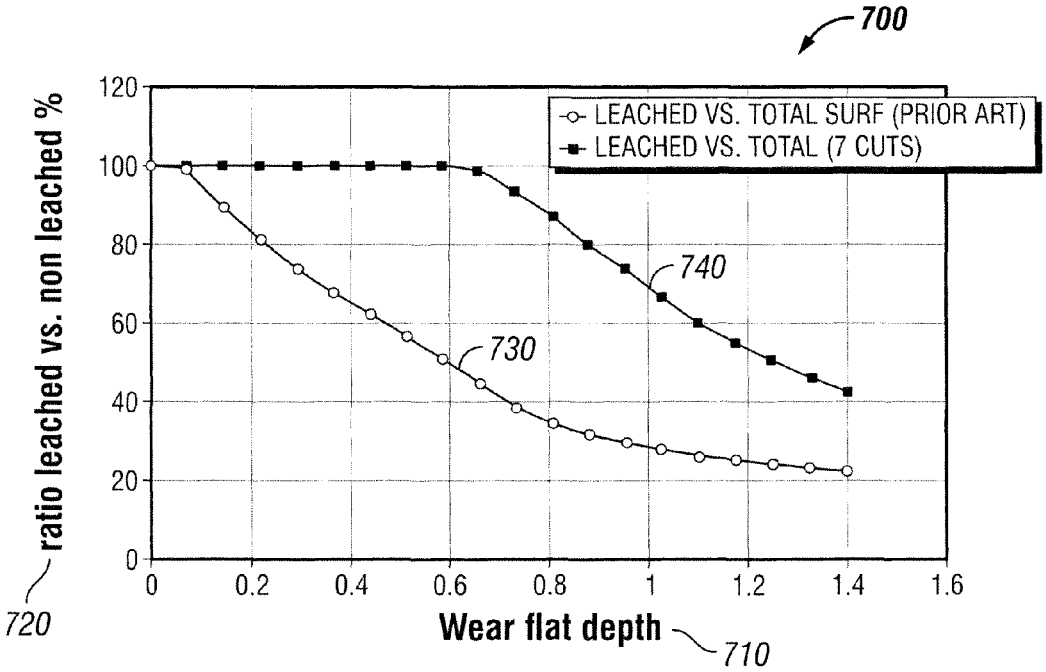
FIG. 7 shows a graphical wear flat depth and exposed thermally stable shell percentage of the overall wear flat surface relationship for the prior art PCD cutting table and the PCD cutting table in accordance with an exemplary embodiment of the present invention.

FIG. 7 shows a graphical wear flat depth and exposed thermally stable shell percentage of the overall wear flat surface relationship 700 for the prior art PCD cutting table 110 (FIG. 1) and the PCD cutting table 410 (FIG. 4) in accordance with an exemplary embodiment of the present invention. Referring to FIG. 7, the graphical wear flat depth and exposed thermally stable shell percentage of the overall wear flat surface relationship 700 includes a wear flat depth axis 710, an exposed thermally stable shell percentage of the overall wear flat surface axis 720, a prior art PCD cutting table relationship 730, and an improved PCD cutting table relationship 740.

The wear flat depth axis 710 is positioned on the x-axis and represents the depth of the wear flat that is formed on the PCD cutting table. The wear flat depth is measured in millimeter units. Proceeding from left to right along the wear flat depth axis 710, the depth of the wear flat on the PCD cutting table increases.

The exposed thermally stable shell percentage of the overall wear flat surface axis 720 is positioned on the y-axis and represents the thermally stable shell that is exposed on the overall wear flat surface. The thermally stable shell that is exposed on the overall wear flat surface is measured in percentages. Proceeding from top to bottom along the exposed thermally stable shell percentage of the overall wear flat surface axis 720, the percentage of the thermally stable shell that is exposed on the overall wear flat surface decreases.

The prior art PCD cutting table relationship 730, depicted using diamond symbols, shows the relationship between the wear flat depth and the exposed thermally stable shell percentage of the overall wear flat surface for PCD cutting table 110 (FIG. 1). According to the prior art PCD cutting table relationship 730, portions of the catalyst rich PCD cutting table 310 (FIG. 3A) begin to be exposed when the wear flat depth is about 0.1 millimeters or slightly less. Thus, degradation of the PDC cutting table 110 (FIG. 1) increases once the wear flat depth reaches about 0.1 millimeters; thereby allowing the amount of catalyst rich PCD cutting table 310 (FIG. 3A) that is exposed to steadily increase and the amount of thermally stable shell to steadily decrease.

The improved PCD cutting table relationship 740, depicted using square symbols, shows the relationship between the wear flat depth and the exposed thermally stable shell percentage of the overall wear flat surface for PCD cutting table 410 (FIG. 4). PCD cutting table 410 (FIG. 4) includes seven slots 420 (FIG. 4) according to one exemplary embodiment. According to the improved PCD cutting table relationship 740, portions of the catalyst rich PCD cutting table 610 begin to be exposed when the wear flat depth is about 0.65 millimeters. Thus, degradation of the PDC cutting table 410 (FIG. 4) increases once the wear flat depth reaches about 0.65 millimeters. Comparing the prior art PCD cutting table relationship 730 to the improved PCD cutting table relationship 740, when the wear flat depth is 0.6 millimeters, the exposed thermally stable shell percentage of the overall wear flat surface for PCD cutting table 410 (FIG. 4) is about one hundred percent, while the exposed thermally stable shell percentage of the overall wear flat surface for PCD cutting table 110 (FIG. 1) is about fifty percent. For a wear depth higher than 0.6 millimeters, the exposed thermally stable shell percentage of the overall wear flat surface for PCD cutting table 410 (FIG. 4) is always higher than the exposed thermally stable shell percentage of the overall wear flat surface for PCD cutting table 110 (FIG. 1). Thus, the graphical wear flat depth and exposed thermally stable shell percentage of the overall wear flat surface relationship 700 illustrates that PCD cutting table 410 (FIG. 4) has a better performance and a much longer longevity than PDC cutting table 110 (FIG. 1).

Figure 8:
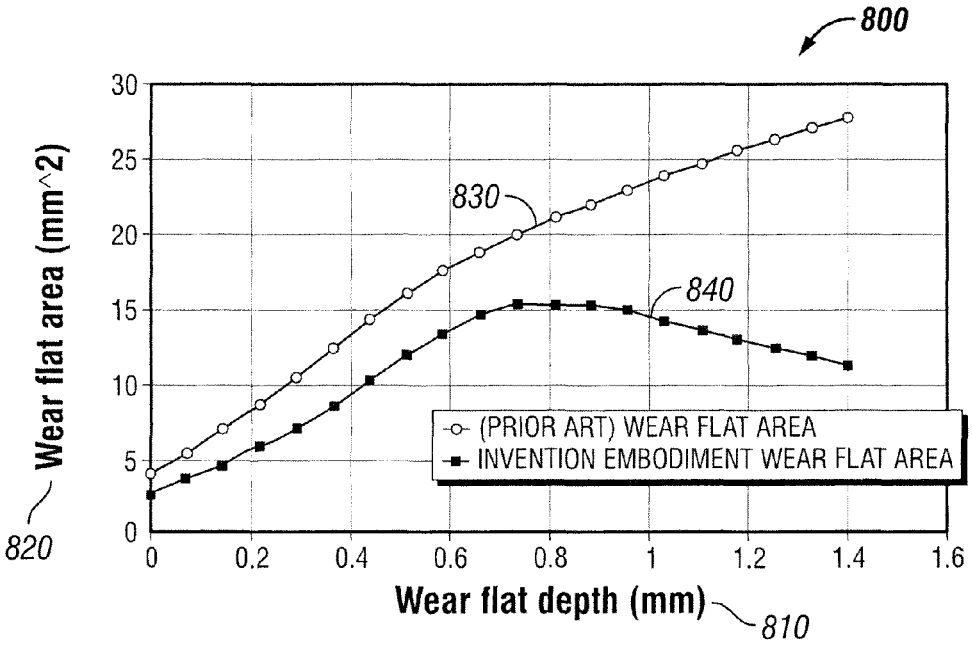
FIG. 8 shows a graphical wear flat depth and wear flat area for the PCD cutting table relationship of the prior art PCD cutting table and the PCD cutting table in accordance with an exemplary embodiment of the present invention.

FIG. 8 shows a graphical wear flat depth and wear flat area of the PCD cutting table relationship 800 for the prior art PCD cutting table 110 (FIG. 1) and the PCD cutting table 410 (FIG. 4) in accordance with an exemplary embodiment of the present invention. Referring to FIG. 8, the graphical wear flat depth and wear flat area of the PCD cutting table relationship 800 includes a wear flat depth axis 810, a wear flat area axis 820, a prior art PCD cutting table relationship 830, and an improved PCD cutting table relationship 840.

The wear flat depth axis 810 is positioned on the x-axis and represents the depth of the wear flat that is formed on the PCD cutting table. The wear flat depth is measured in millimeter units. Proceeding from left to right along the wear flat depth axis 810, the depth of the wear flat on the PCD cutting table increases.

The wear flat area axis 820 is positioned on the y-axis and represents the area of the wear flat that makes contact with the rock formation. The area of the wear flat is measured in squared millimeters. Proceeding from bottom to top along the wear flat area axis 820, the area of the wear flat that makes contact with the rock formation increases. As the wear flat area increases, the amount of heat being generated also increases due to the additional amount of rock formation rubbing surface. As the rock contact stress level drops, the weight on bit ("WOB") is increased to maintain the rate of penetration ("ROP"). The increased WOB results in more heat being generated with the effect of accelerating cutter degradation. Thus, for improved cutting performance, it is better to have a lower wear flat area.

The prior art PCD cutting table relationship 830, depicted using diamond symbols, shows the relationship between the wear flat depth and the area of the wear flat that makes contact with the rock formation for PCD cutting table 110 (FIG. 1). According to the prior art PCD cutting table relationship 830, the area of the wear flat increases as the depth of the wear flat increases. As shown in FIG. 8 with respect to the prior art PCD cutting table relationship 830, the area of the wear flat is about four squared millimeters when the depth of the wear flat is about zero millimeters. The area of the wear flat is about twenty-one squared millimeters when the depth of the wear flat is about 0.8 millimeters. The area of the wear flat is about 27.5 squared millimeters when the depth of the wear flat is about 1.4 millimeters. Thus, as the area of the wear flat increases, the heat generated also increases. The WOB is increased to maintain the ROP, which results in even more heat being generated. Hence, cutter degradation is increased when using the PCD cutting table 110 (FIG. 1).

The improved PCD cutting table relationship 840, depicted using square symbols, shows the relationship between the wear flat depth and the area of the wear flat that makes contact with the rock formation for PCD cutting table 410 (FIG. 4). PCD cutting table 410 (FIG. 4) includes seven slots 420 (FIG. 4) according to one exemplary embodiment. According to the improved PCD cutting table relationship 840, the area of the wear flat increases as the depth of the wear flat increases from about zero millimeters to about 0.8 millimeters. However, the area of the wear flat decreases as the depth of the wear flat increases from about 0.8 millimeters to about 1.4 millimeters. Thus, at about a 0.8 millimeters wear flat depth, the maximum amount of PCD cutting table 410 (FIG. 4) is contacting the rock formation. This reduction of area that makes contact with the rock formation for PCD cutting table 410 (FIG. 4), which starts from about 0.8 millimeters and greater, occurs due to the slots 420 (FIG. 4) formed within the PCD cutting table 420 (FIG. 4). These slots 420 (FIG. 4) have material removed thereby allowing less wear flat area to make contact with the rock formation as the wear flat depth increases after reaching 0.8 millimeters. As shown in FIG. 8 with respect to the improved PCD cutting table relationship 840, the area of the wear flat is about three squared millimeters when the depth of the wear flat is about zero millimeters. The area of the wear flat is about fifteen squared millimeters when the depth of the wear flat is about 0.8 millimeters. The area of the wear flat is about eleven squared millimeters when the depth of the wear flat is about 1.4 millimeters. As illustrated, the PCD cutting table 410 (FIG. 4) allows for a smaller wear flat area increases when compared to PCD cutting table 110 (FIG. 1). This translates into a smaller WOB increment to maintain the same ROP with beneficial effects of lesser amounts of heat being generated when compared to operations of the PCD cutting table 110 (FIG. 1). Additionally, once the PCD cutting table 410 (FIG. 4) reaches a wear flat depth of 0.8 millimeters, less area of the wear flat contacts the rock formation as the wear flat depth increases beyond 0.8 millimeters. This translates into not having to increase the WOB. If the same WOB is maintained, an increase in ROP results.

Figure 9:
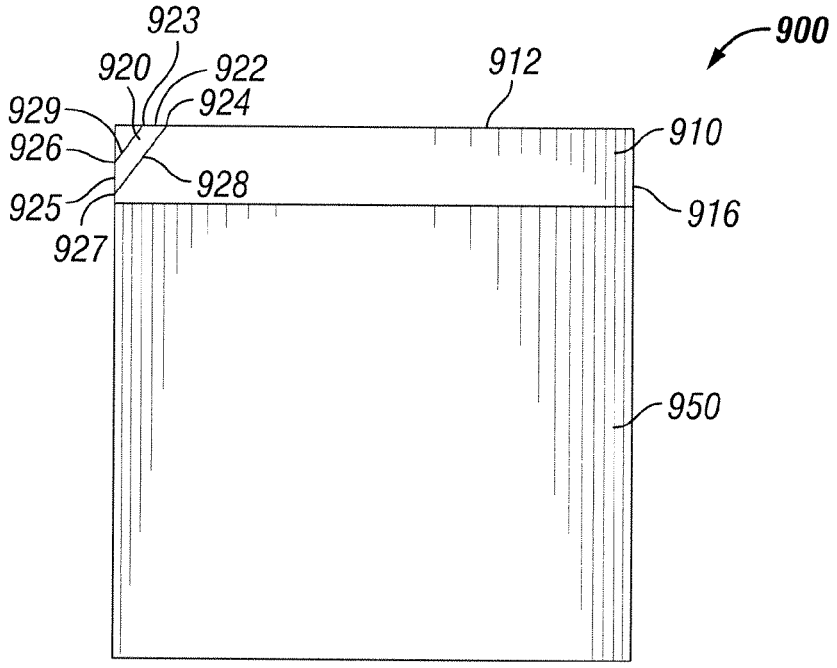
FIG. 9 shows a side view of a PDC cutter in accordance with another exemplary embodiment of the present invention.

FIG. 9 shows a side view of a PDC cutter 900 in accordance with another exemplary embodiment of the present invention. Referring to FIG. 9, the PDC cutter 900 includes a PCD cutting table 910 that is coupled to a substrate 950 according to methods known to people having ordinary skill in the art. The PDC cutter 900 is similar to PDC cutter 400 (FIG. 4) except PCD cutting table 910 includes at least one slot 920 that is different than the slot 420 (FIG. 4). Similar to PCD cutting table 410 (FIG. 4), PCD cutting table 910 includes a cutting surface 912 and a PCD cutting table outer wall 916.

Each slot 920, or borehole, is substantially tubularly shaped and includes a slot latitudinal edge 922, a slot longitudinal edge 925, a first slot angular edge 928, and a second slot angular edge 929. The slot latitudinal edge 922 is formed along a portion of the cutting surface. The slot longitudinal edge 925 is formed along a portion of the PCD cutting table outer wall 916. Each of the first slot angular edge 928 and the second slot angular edge 929 extend from a portion of the slot latitudinal edge 922 to a portion of the slot longitudinal edge 925. The portion of the PCD cutting table 910 that is bounded by the slot latitudinal edge 922, the slot longitudinal edge 925, the first slot angular edge 928, and the second slot angular edge 929 is removed, thereby forming the slot 920. Although some exemplary embodiments include tubular shaped slots 920, other exemplary embodiments have slots that are shaped in other geometric, such as square or trapezoidal, or non-geometric shapes without departing from the scope and spirit of the exemplary embodiment. The slots 920 are formed substantially near the outer perimeter of the PCD cutting table 910 since that is the area performing most of the cutting. The slots 920 formed within the PCD cutting table 910 provide greater accessible surface area of the PCD cutting table 910 for the leaching process. Hence, a greater volume of the PCD cutting table 910 is subjected to the treatment of the leaching process; thereby forming an improved PCD cutting table 910 that is more thermally stable than the PCD cutting table 110 (FIG. 1) in the area performing most of the cutting.

The slot latitudinal edge 922 includes a slot latitudinal adjacent end 923 and a slot latitudinal distal end 924 and extends from the slot latitudinal adjacent end 923 to the slot latitudinal distal end 924 substantially linearly. However, in other exemplary embodiments, the slot latitudinal edge 922 is substantially circular and includes the slot latitudinal adjacent end 923 and the slot latitudinal distal end 924 along opposing ends of the circumference of the slot latitudinal edge 922. The slot latitudinal adjacent end 923 is positioned at a point within the circumference of the cutting surface 912. The slot latitudinal distal end 924 is positioned at a point within the circumference of the cutting surface 912 and closer towards the center of the cutting surface 912 than the positioning of the slot latitudinal adjacent end 923.

The slot longitudinal edge 925 includes a slot longitudinal adjacent end 926 and a slot longitudinal distal end 927 and extends from the slot longitudinal adjacent end 926 to the slot longitudinal distal end 927 substantially linearly. However, in other exemplary embodiments, the slot longitudinal edge 925 is substantially circular and includes the slot longitudinal adjacent end 926 and the slot longitudinal distal end 927 along opposing ends of the circumference of the slot longitudinal edge 925. The slot longitudinal adjacent end 926 is positioned along the PCD cutting table outer wall 916 at a point below where the PCD cutting table outer wall 916 meets with the circumference of the cutting surface 912. The slot longitudinal distal end 927 is positioned along the PCD cutting table outer wall 916 at a point below the slot longitudinal adjacent end 926, which is further away from where the PCD cutting table outer wall 916 meets with the circumference of the cutting surface 912 when compared to the positioning of the slot longitudinal adjacent end 926. The slot longitudinal distal end 927 is vertically aligned with the slot longitudinal adjacent end 926. In other exemplary embodiments, however, the slot longitudinal distal end 927 is not vertically aligned with the slot longitudinal adjacent end 926.

The first slot angular edge 928 extends from the slot latitudinal distal end 924 to the slot longitudinal distal end 927. The first slot angular edge 928 forms an angle ranging from about five degrees to about eighty-five degrees to the cutting surface 912, which is dependent upon the thickness of the PCD cutting table 910. According to some exemplary embodiments, the first slot angular edge 928 forms an angle with respect to the cutting surface 912 that is about equal to the backrake angle of the cutter 900 when positioned in a downhole tool (not shown).

The second slot angular edge 929 extends from the slot latitudinal adjacent end 923 to the slot longitudinal adjacent end 926. The second slot angular edge 929 forms an angle ranging from about five degrees to about eighty-five degrees to the cutting surface 912, which is dependent upon the thickness of the PCD cutting table 910. According to some exemplary embodiments, the second slot angular edge 929 forms an angle with respect to the cutting surface 912 that is about equal to the backrake angle of the cutter 900 when positioned in a downhole tool. Although the first slot angular edge 928 is substantially parallel to the second slot angular edge 929, the first slot angular edge 928 is not substantially parallel to the second slot angular edge 929 in other exemplary embodiments.

Figure 10:
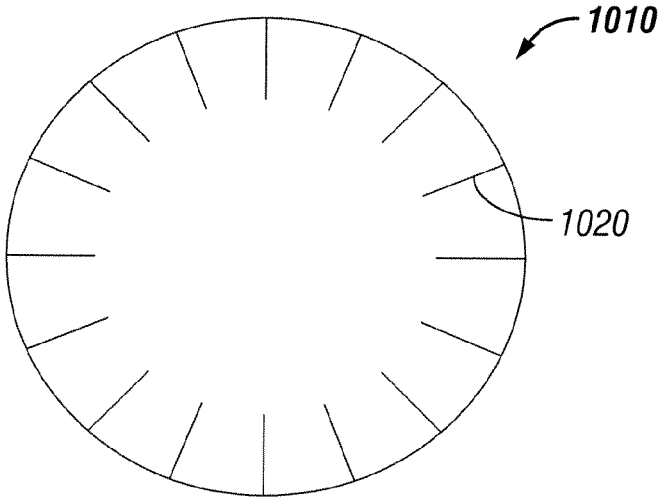
FIG. 10 shows a top view of a PCD cutting table in accordance with another exemplary embodiment of the present invention.

FIG. 10 shows a top view of a PCD cutting table 1010 in accordance with another exemplary embodiment of the present invention. The PCD cutting table 1010 includes one or more slots 1020 and is similar to PCD cutting table 410 (FIG. 4), except the slots 1020 are formed in a circumferential array, or radially, around the entire outer perimeter of the PCD cutting table 1010. Slots 1020 are formed similarly to slots 420 (FIG. 4), but can also be formed similar to slots 920 (FIG. 9) in other exemplary embodiments. According to some exemplary embodiments, however, the circumferential array of slots 1020 is formed around a portion of the perimeter of the PCD cutting table 1010. The minimum spacing between the slots 1020 is about thirty-three thousandths of an inch according to some exemplary embodiments; however, other exemplary embodiments have a minimum spacing between adjacent slots 1020 being less than thirty-three thousandths of an inch. Further, although the slots 1020 are formed equidistantly from one another, the spacing between adjacent slots 1020 can be varied in certain exemplary embodiments.

Figure 11:
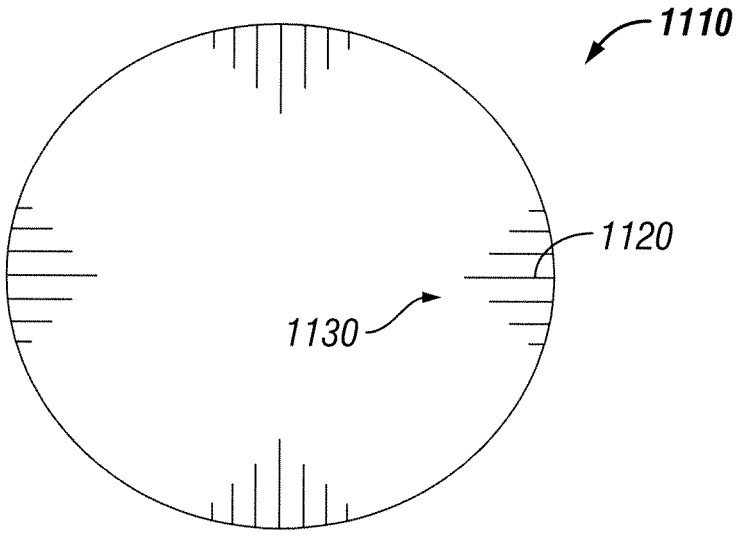
FIG. 11 shows a top view of a PCD cutting table in accordance with another exemplary embodiment of the present invention.

FIG. 11 shows a top view of a PCD cutting table 1110 in accordance with another exemplary embodiment of the present invention. The PCD cutting table 1110 is similar to PCD cutting table 410 (FIG. 4), except that PCD cutting table 1110 includes one or more groups 1130 of slots 1120. Slots 1120 are formed similarly to slots 420 (FIG. 4), but can be formed similarly to slots 920 (FIG. 9) in other exemplary embodiments. There are four groups 1130 that are oriented about ninety degrees apart; however, the separation between adjacent groups can be at various angles ranging from about forty-five degrees to 180 degrees depending upon application desires and the number of slots 1120 within each group 1130. According to one exemplary embodiment, four groups 1130 are formed within the PCD cutting table 1110. Each group 1130 includes seven parallel slots 1120. The number of slots 1120 per group 1130 is variable in different exemplary embodiments. Additionally, the number of groups 1130 is variable in different exemplary embodiments. Further, the slots 1120 can be positioned radially, instead of parallel, according to some exemplary embodiments. Groups 1130 are formed around the PCD cutting table 1110 so that the cutter (not shown) can be removed, rotated, and reinserted into the downhole tool (not shown), or other tool, for reuse, thereby providing a new, or fresh, edge of the PDC cutting table 1110 for cutting. For example, once a first group 1130 of slots 1120 are worn away by cutting a rock formation, the cutter can be rotated to expose a different group 1130 that is unworn for further cutting of the rock formation.

Figure 12:
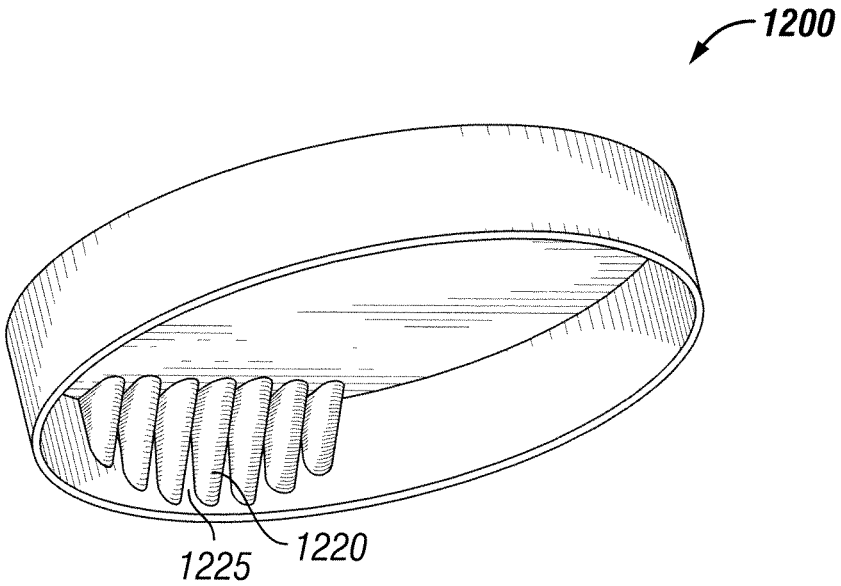
FIG. 12 shows a perspective view of a thermally stable shell of a PCD cutting table in accordance with another exemplary embodiment of the present invention.

FIG. 12 shows a perspective view of a thermally stable shell 1200 of a PCD cutting table (not shown) in accordance with another exemplary embodiment of the present invention. The thermally stable shell 1200 is similar to thermally stable shell 500 (FIG. 5), except that thermally stable shell 1200 includes one or more ribs 1220 within the interior portion of the substantially cup-shaped thermally stable shell 1200, wherein at least one rib 1220 is space further apart when compared to ribs 520 (FIG. 5). These ribs 1220 form a portion of the thermally stable shell 1200 and are formed due to the inwardly moving leaching process occurring around the slots (not shown). At least one rib 1220 forms a channel 1225 between at least two adjacent ribs 1220. Hence, the slots formed within the thermally stable shell 1200 are also spaced further apart than the slots 420 (FIG. 4).

Figure 13:
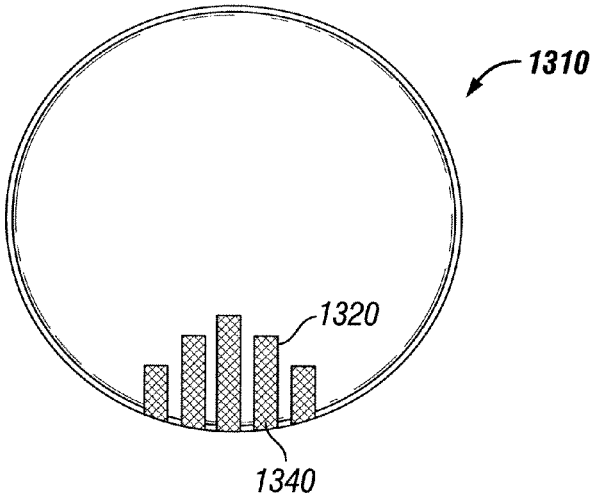
FIG. 13 shows a top view of a PCD cutting table in accordance with another exemplary embodiment of the present invention.

FIG. 13 shows a top view of a PCD cutting table 1310 in accordance with another exemplary embodiment of the present invention. The PCD cutting table 1310 includes one or more slots 1320 and is similar to PCD cutting table 410 (FIG. 4), except the slots 1320 are backfilled using a backfilling material 1340 according to some of the exemplary embodiments. According to some exemplary embodiments, the backfilling material 1340 completely backfills the slots 1320. According to alternative exemplary embodiments, the backfilling material 1340 backfills a portion of the slots 1320. The slots 1320 are formed according to any of the exemplary embodiments previously discussed. Upon forming the slots 1320, the PCD cutting table 1310 is leached using leaching methods known to people having ordinary skill in the art. Thus, the PCD cutting table 1310 provides the benefits mentioned within the present disclosure. Upon leaching the PCD cutting table 1310, one or more slots 1320 are backfilled using the backfilling material 1340. The backfilling material 1340 includes any ceramic, metal, metal alloy, carbon vapor deposition ("CVD") diamond, or cubic boron nitride ("CBN"). According to some examples, the metal is any metal that is reactive to carbon to form a carbide. Some examples of these metal include, but are not limited to, molybdenum, titanium, vanadium, iron, nickel, and niobium.

There are several techniques that can be used for applying the backfilling material 1340 to the surface of the PCD cutting table 1310. Some of these techniques include, but are not limited to, painting, coating, soaking, dripping, plasma vapor deposition, chemical vapor deposition, and plasma enhanced chemical vapor deposition and can be used in conjunction with masking certain portions of the top surface of the PCD cutting table 1310. These backfilling techniques are described in U.S. patent application Ser. No. 12/716,208, entitled "Backfilled Polycrystalline Diamond Cutter With High Thermal Conductivity" and filed on Mar. 2, 2010, which is incorporated by reference herein.

According to some exemplary embodiments, the backfilling material 1340 is applied to the surface of the PCD cutting table 1310 by inserting the backfilling material 1340, which can be either in wire form or in powder form, into the slots 1320. Upon inserting the backfilling material 1340 within one or more slots 1320, the PCD cutting table 1310 is subjected to the high pressure high temperature conditions so that the backfilling material 1340 reacts with the carbon within the PCD cutting table 1310 to convert the backfilling material 1340 into its carbide form.

According to some exemplary embodiments using certain techniques, such as chemical vapor deposition, substantially all of the top surface of the PCD cutting table 1310 has a mask placed thereon except for the slots 1320, so that only the slots 1320 are backfilled. According to certain other exemplary embodiments using certain techniques, such as chemical vapor deposition, the interior portion of the top surface of the PCD cutting table 1310 has a mask placed thereon except for the outer circumference of the PCD cutting table 1310, which includes the slots 1320. Thus, the slots 1320 and the outer circumference of the PCD cutting table 1310 are backfilled.

The slots 1320 are backfilled using backfilling material 1340 to improve thermal conductivity so that the heat generated within the PCD cutting table 1310 during cutting can be routed to the surrounding environment in a faster manner according to some exemplary embodiments. In other exemplary embodiments, the slots 1320 are backfilled using backfilling material 1340 to improve the impact strength of the PCD cutting table 1310 depending upon the application that the PCD cutting table 1310 is to be used in.

Figure 14A:
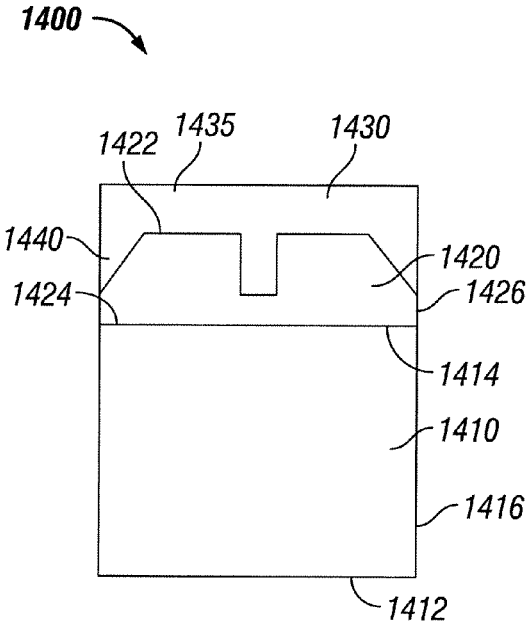
FIG. 14A shows a side view of a slot fabricating apparatus for fabricating one or more slots in accordance with an exemplary embodiment of the present invention.
Figure 14B:
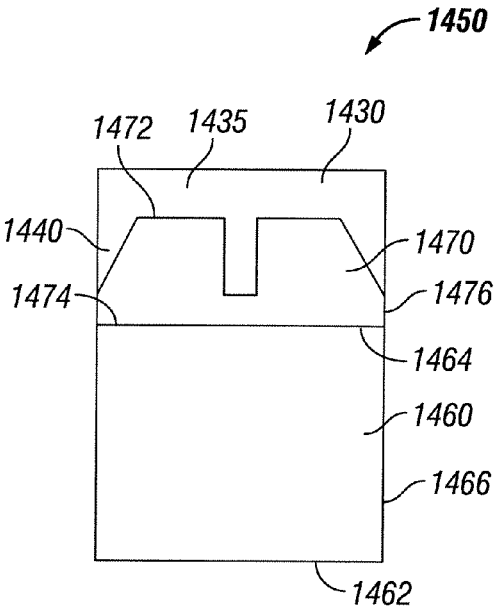
FIG. 14B shows a side view of a sintered slot fabricating apparatus formed from the sintering of the slot fabricating apparatus of FIG. 14A in accordance with an exemplary embodiment of the present invention.
Figure 14C:
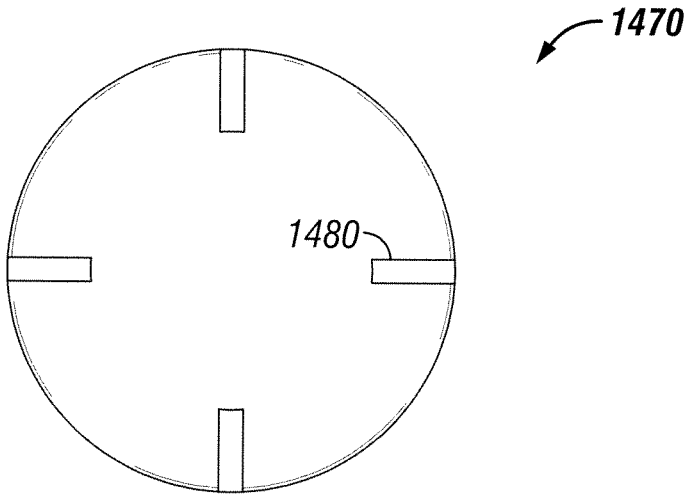
FIG. 14C shows a top view of the PCD cutting table of FIG. 14B in accordance with an exemplary embodiment of the present invention.

FIG. 14A shows a side view of a slot fabricating apparatus 1400 for fabricating one or more slots 1480 in accordance with an exemplary embodiment of the present invention. FIG. 14B shows a side view of a sintered slot fabricating apparatus 1450 formed from the sintering of the slot fabricating apparatus 1400 of FIG. 14A in accordance with an exemplary embodiment of the present invention. FIG. 14C shows a top view of the PCD cutting table 1470 of FIG. 14B in accordance with an exemplary embodiment of the present invention. Referring to FIGS. 14A, 14B, and 14C, the slot fabricating apparatus 1400 includes a substrate layer 1410, a PCD cutting table layer 1420, and a cap 1430. The substrate layer 1410 is positioned at the bottom of the slot fabricating apparatus 1400 and forms a substrate 1460 upon performing the sintering process. The PCD cutting table layer 1420 is positioned atop the substrate layer 1410 and forms a PCD cutting table 1470 upon performing the sintering process. The cap 1430 includes a top portion 1435 and one or more extenders 1440. The cap 1430 is positioned atop the PCD cutting table layer 1420 and the extenders 1440 are positioned so that the extenders 1440 extend from the top portion 1435 into portions of the outer circumference of the PCD cutting table layer 1420.

The substrate layer 1410 is formed from tungsten carbide powder and cobalt powder. Once subjected to high pressures and high temperatures, the substrate layer 1410 forms the substrate 1460. However, in alternative exemplary embodiments, the substrate layer 1410 is formed from other suitable materials known to people having ordinary skill in the art. The substrate layer includes a top layer surface 1412, a bottom layer surface 1414, and a substrate layer outer wall 1416 that extends from the circumference of the top layer surface 1412 to the circumference of the bottom layer surface 1414. The substrate layer 1410 is formed into a right circular cylindrical shape according to one exemplary embodiment, but can be formed into other geometric or non-geometric shapes.

The PCD cutting table layer 1420 is formed from diamond powder and a catalyst material, such as cobalt; however, other suitable materials known to people having ordinary skill in the art can be used without departing from the scope and spirit of the exemplary embodiment. Once subjected to high pressures and high temperatures, the PCD cutting table layer 1420 forms the PCD cutting table 1470. The PCD cutting table layer 1420 includes a cutting layer surface 1422, an opposing layer surface 1424, and a PCD cutting table layer outer wall 1426 that extends from the circumference of the cutting layer surface 1422 to the circumference of the opposing layer surface 1424.

The cap 1430 is formed from molybdenum; however, the cap 1430 is formed from any other suitable material, such as tungsten or any other material known to people having ordinary skill in the art, in other exemplary embodiments. The cap 1430 is placed atop the PCD cutting table layer 1420 such that the extenders 1440 extend from the top portion 1435 of the cap 1430 and proceed into a portion of the cutting layer surface 1422 and to a portion of the PCD cutting table layer outer wall 1426. In some exemplary embodiments, the extenders 1440 are positioned substantially towards the outer perimeter of the PCD cutting table layer 1420.

Once the slot fabricating apparatus 1400 is formed, the slot fabricating apparatus 1400 is subjected to high pressure and high temperature conditions to form the sintered slot fabricating apparatus 1450. Within the sintered slot fabricating apparatus 1450, the substrate 1460 is formed, the PCD cutting layer 1470 is formed, the substrate 1460 is bonded to the PCD cutting layer 1470, and the cap 1430 is bonded to the PCD cutting layer 1470. The substrate 1460 includes a top surface 1462, a bottom surface 1464, and a substrate outer wall 1466 that extends from the circumference of the top surface 1462 to the circumference of the bottom surface 1464. The PCD cutting table 1470 includes a cutting surface 1472, an opposing surface 1474, and a PCD cutting table outer wall 1476 that extends from the circumference of the cutting surface 1472 to the circumference of the opposing surface 1474. The opposing surface 1474 is bonded to the top surface 1462 and the top portion 1435 of the cap 1430 is bonded to the cutting surface 1472.

Upon forming the sintered slot fabricating apparatus 1450, the cap 1430 is removed. The removal of the extenders 1440 form the slots 1480 within the PCD cutting table 1470. The slots 1480 extend from a portion of the cutting surface 1472 to a portion of the PCD cutting table outer wall 1476. Although each slot 1480 is formed at ninety degrees from one another, the slots 1480 are formed according to any of the previously mentioned exemplary embodiments in other exemplary embodiments. According to certain exemplary embodiments of the slots 1480, the extenders 1440 of the cap 1430 are modified so that boreholes extending from a portion of the cutting surface 1472 to a portion of the PCD cutting table outer wall 1476 can be formed. The cap 1430 is removed using acid and dissolving the cap 1430 according to one exemplary embodiment. In certain exemplary embodiment, the acid is allowed to leach catalyst material from portions of the PCD cutting table 1470, including surrounding areas near the slots 1480. In other exemplary embodiments, the cap 1430 is removed mechanically, chemically, via laser, or any other methods known to people having ordinary skill in the art.

One significant advantage of the functionally leached PDC cutter results from the ridged and relieved or serrated edge the cutter presents to the rock formation to be drilled. The slots embodied within the cutters provide passages for rock flour to exit the cutter face. The diamond working surfaces at the cutting edge that remain between the slots are able to attack the formation with a higher point loading than a comparable prior art cutting edge, which results in higher rates of penetration while drilling. Even in the embodiments where the slots have been backfilled with a metal or ceramic, the metal or ceramic will wear more quickly than the diamond working surface, thereby resulting in the advantageous serrated edge.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A cutting table, comprising:

a cutting surface comprising a cutting surface circumference;

an opposing surface comprising an opposing surface circumference;

a cutting table outer wall extending from the opposing surface circumference to the cutting surface circumference, the cutting table outer wall being entirely orthogonal to the opposing surface;

two or more slots extending from a portion of the cutting surface to a portion of the cutting table outer wall, the entire slot disposed above the opposing surface, and each slot comprising a first side wall, a second side wall positioned opposite and substantially parallel to the first side wall, and a slot latitudinal distal end positioned within the cutting surface, wherein the cutting surface, the opposing surface, and the cutting table outer wall are fabricated from polycrystalline diamond; and ribs of thermally stable material positioned about each of said two or more slots, wherein at least one rib of thermally stable material contacts at least one adjacent rib of thermally stable material.

2. The cutting table of claim 1, wherein the two or more slots comprise a first slot and an adjacent second slot, the first slot being parallel to the adjacent second slot.

3. The cutting table of claim 1, wherein at least a portion of the two or more slots are positioned circumferentially around at least a portion of the cutting surface.

4. The cutting table of claim 1, wherein the two or more slots form at least a first group of slots and a second group of slots, the second group of slots being positioned about forty-five degrees to about 180 degrees apart from the first group of slots.

5. The cutting table of claim 1, wherein the two or more slots are formed around the outer perimeter of the cutting surface.

6. The cutting table of claim 1, wherein the two or more slots are formed after the cutting table is formed.

7. The cutting table of claim 1, wherein the two or more slots are formed during the formation of the cutting table.

8. The cutting table of claim 1, wherein at least the cutting surface and the two or more slots are subjected to a leaching process.

9. The cutting table of claim 1, wherein at least one of the two for more slots comprises:

a slot latitudinal edge positioned along the cutting surface, the slot latitudinal edge comprising a slot latitudinal adjacent end and the slot latitudinal distal end;

a slot longitudinal edge positioned along the cutting table outer wall, the slot longitudinal edge comprising a slot longitudinal adjacent end and a slot longitudinal distal end; and a first slot angular edge extending from the slot latitudinal distal end to the slot longitudinal distal end.

10. The cutting table of claim 9, wherein the slot latitudinal adjacent end is the same as the slot longitudinal adjacent end.

11. The cutting table of claim 9, wherein the at least one of the two or more slots further comprises a second slot angular edge extending from the slot latitudinal adjacent end to the slot longitudinal adjacent end, wherein the slot latitudinal adjacent end is different than the slot longitudinal adjacent end.

12. The cutting table of claim 9, wherein the slot longitudinal distal end is vertically aligned with the slot longitudinal adjacent end.

13. The cutting table of claim 1, wherein at least one of the two or more slots forms a borehole.

14. The cutting table of claim 1, wherein at least one of the two or more slots is backfilled with a backfilling material.

15. The cutter of claim 1, wherein the contact between said ribs of thermally stable material extends along substantially all of the second side wall of a first of said two or more slots and along substantially all of the first side wall of a second of said two or more slots.

16. A cutter, comprising:

a substrate comprising a top surface;

a cutting table, comprising:

a cutting surface comprising a cutting surface circumference;

an opposing surface coupled to the top surface, said opposing surface comprising an opposing surface circumference;

a cutting table outer wall extending from the opposing surface circumference to the cutting surface circumference, the cutting table outer wall being entirely orthogonal to the opposing surface;

two or more slots extending from a portion of the cutting surface to a portion of the cutting table outer wall, the entire slot disposed above the opposing surface, and each slot comprising a first side wall, a second side wall positioned opposite, and a slot latitudinal distal end positioned within the cutting surface, wherein the first side wall is substantially perpendicular to said cutting surface, wherein the cutting surface, the opposing surface, and the cutting table outer wall are fabricated from polycrystalline diamond; and ribs of thermally stable material positioned about each of said two or more slots, wherein at least one rib of thermally stable material contacts at least one adjacent rib of thermally stable material.

17. The cutter of claim 16, wherein the two or more slots comprise a first slot and an adjacent second slot, the first slot being parallel to the adjacent second slot.

18. The cutter of claim 16, wherein at least a portion of the two or more slots are positioned circumferentially around at least a portion of the cutting surface.

19. The cutter of claim 16, wherein the two or more slots form at least a first group of slots and a second group of slots, the second group of slots being positioned about forty-five degrees to about 180 degrees apart from the first group of slots.

20. The cutter of claim 16, wherein the two or more slots are formed around the outer perimeter of the cutting surface.

21. The cutter of claim 16, wherein the two or more slots are formed after the cutting table is formed.

22. The cutter of claim 16, wherein the two or more slots are formed during the formation of the cutting table.

23. The cutter of claim 16, wherein at least the cutting surface and the two or more slots are subjected to a leaching process.

24. The cutter of claim 16, wherein at least one of the two or more slots comprises:

a slot latitudinal edge positioned along the cutting surface, the slot latitudinal edge comprising a slot latitudinal adjacent end and the slot latitudinal distal end;

a slot longitudinal edge positioned along the cutting table outer wall, the slot longitudinal edge comprising a slot longitudinal adjacent end and a slot longitudinal distal end; and a first slot angular edge extending from the slot latitudinal distal end to the slot longitudinal distal end.

25. The cutter of claim 24, wherein the slot latitudinal adjacent end is the same as the slot longitudinal adjacent end.

26. The cutter of claim 24, wherein the at least one of the two or more slots further comprises a second slot angular edge extending from the slot latitudinal adjacent end to the slot longitudinal adjacent end, wherein the slot latitudinal adjacent end is different than the slot longitudinal adjacent end.

27. The cutter of claim 24, wherein the slot longitudinal distal end is vertically aligned with the slot longitudinal adjacent end.

28. The cutter of claim 16, wherein at least one of the two or more slots forms a borehole.

29. The cutter of claim 16, wherein at least one of the two or more slots is backfilled with a backfilling material.

30. A method for fabricating a cutter, comprising:

forming a cutter table, the cutter table comprising:

a cutting surface comprising a cutting surface circumference;

an opposing surface comprising an opposing surface circumference; and a cutting table outer wall extending from the opposing surface circumference to the cutting surface circumference, the cutting table outer wall being entirely orthogonal to the opposing surface;

bonding the cutter table to a substrate;

forming two or more slots extending from a portion of the cutting surface to a portion of the cutting table outer wall, the entire slot disposed above the opposing surface, and each slot having a maximum depth measured from the cutting surface and comprising a first side wall, a second side wall, and a slot latitudinal distal end positioned within the cutting surface, wherein the first and second side walls are substantially parallel and the second side wall is spaced from the first side wall by a distance substantially less than the maximum depth of the slot from said cutting surface, wherein the cutting surface, the opposing surface, and the cutting table outer wall are fabricated from polycrystalline diamond; and ribs of thermally stable material positioned about each of said two or more slots, wherein at least one rib of thermally stable material contacts at least one adjacent rib of thermally stable material.

31. The method of claim 30, further comprising leaching at least a portion of the cutter table.

32. The method of claim 30, further comprising backfilling at least one of the two or more slots with a backfilling material.

33. The method of claim 30, wherein the two or more slots are formed after the cutting table is formed.

34. The method of claim 30, wherein the two or more slots are formed during the formation of the cutting table.

35. A cutting table, comprising:

a cutting surface comprising a cutting surface circumference;

an opposing surface comprising an opposing surface circumference;

a cutting table outer wall extending from the opposing surface circumference to the cutting surface circumference, the cutting table outer wall being entirely orthogonal to the opposing surface;

two or more slots extending from a portion of the cutting surface to a portion of the cutting table outer wall, each slot comprising a first side wall, a second side wall positioned opposite the first side wall, and a slot latitudinal distal end positioned within the cutting surface, both side walls extending from a portion of the cutting surface to a portion of the cutting table outer wall, the entire slot disposed above the opposing surface, wherein the first side wall is substantially parallel to the second side wall, and wherein the cutting table is fabricated from polycrystalline diamond; and ribs of thermally stable material positioned about each of said two or more slots, wherein at least one rib of thermally stable material contacts at least one adjacent rib of thermally stable material.

36. The cutting table of claim 35, further comprising leaching at least a portion of the cutter table.

37. The cutting table of claim 35, further comprising backfilling at least one of the two or more slots with a backfilling material.

38. A cutter, comprising:

a substrate comprising a top surface;

a cutting table, comprising:

a cutting surface comprising a cutting surface circumference;

an opposing surface coupled to the top surface, said opposing surface comprising an opposing surface circumference;

a cutting table outer wall extending from the opposing surface circumference to the cutting surface circumference, the cutting table outer wall being entirely orthogonal to the opposing surface;

two or more slots extending from a portion of the cutting surface to a portion of the cutting table outer wall, each slot comprising a slot latitudinal distal end positioned within the cutting surface, the entire slot disposed above the opposing surface, wherein the width of the slot at said cutting surface is approximately equal to or less than the width of the slot below the surface of said cutting table, wherein the cutter is a fixed cutter and the substrate is configured to be non-rotatably coupled to a downhole tool; and ribs of thermally stable material positioned about each of said two or more slots, wherein at least one rib of thermally stable material contacts at least one adjacent rib of thermally stable material.

39. The cutter of claim 38, further comprising leaching at least a portion of the cutter table.

40. The cutter of claim 38, further comprising backfilling at least one of the two or more slots with a backfilling material.

41. A cutter, comprising:

a substrate comprising a top surface;

a cutting table, comprising:

a cutting surface comprising a cutting surface circumference;

an opposing surface coupled to the top surface, said opposing surface comprising an opposing surface circumference;

a cutting table outer wall extending from the opposing surface circumference to the cutting surface circumference;

two or more slots extending from a portion of the cutting surface to a portion of the cutting table outer wall, at least one slot extending at least fifty percent of the length of the cutting table outer wall, the entire slot disposed above the opposing surface, and each slot comprising a first side wall, a second side wall positioned opposite and substantially parallel to the first side wall, and a slot latitudinal distal end positioned within the cutting surface, wherein the cutting table is fabricated from polycrystalline diamond; and ribs of thermally stable material positioned about each of said two or more slots, wherein at least one rib of thermally stable material contacts at least one adjacent rib of thermally stable material.

42. The cutter of claim 41, further comprising leaching at least a portion of the cutter table.

43. The cutter of claim 41, further comprising backfilling at least one of the two or more slots with a backfilling material.

* * * * *